United States Patent [19]

Kromrey et al.

[11] Patent Number: 4,802,630

[45] Date of Patent: Feb. 7, 1989

[54] ASPIRATING FOAMER

[75] Inventors: Edward P. Kromrey, Osceola, Wis.; Richard J. Mehus, Bershire, England

[73] Assignee: Ecolab Inc., St. Paul, Minn.

[21] Appl. No.: 914,054

[22] Filed: Oct. 6, 1986

Related U.S. Application Data

[63] Continuation-in-part of Ser. No. 799,423, Nov. 19, 1985, abandoned.

[51] Int. Cl.[4] ..... B05B 7/04

[52] U.S. Cl. ..... 239/428; 239/434

[58] Field of Search ..... 239/366–368, 239/311, 318, 304, 307, 417.5, 428, 433, 434, 8, 9, 427.5, 10, 601, 343, 543, 545; 169/14, 15; 521/917; 366/150, 177, 163; 261/DIG. 26, DIG. 75; 422/133, 134

[56] References Cited

U.S. PATENT DOCUMENTS

| | | | |
|---|---|---|---|
| 2,571,871 | 10/1951 | Hayes | 103/262 |
| 2,630,183 | 3/1953 | Foutz | 169/15 |
| 2,715,045 | 8/1955 | Thompson | 299/86 |
| 2,765,856 | 10/1956 | Schultz | 164/15 |
| 2,774,583 | 12/1956 | Haftke | 261/76 |
| 3,122,327 | 2/1964 | Wiedorn | 239/431 |
| 3,188,009 | 6/1965 | Miscovich | 239/407 |
| 3,388,868 | 6/1968 | Watson et al. | 239/427 |
| 3,430,865 | 3/1969 | McDougall | 239/9 |
| 3,799,450 | 3/1974 | Braukman | 239/428.5 |
| 3,810,583 | 5/1974 | George | 239/601 X |
| 3,822,217 | 7/1974 | Rogers | 252/359 E |
| 3,836,076 | 9/1974 | Conrad et al. | 239/8 |
| 3,850,371 | 11/1974 | Trapp | 239/307 X |
| 3,853,784 | 12/1974 | Rogers | 252/359 E |
| 3,918,647 | 11/1975 | Lamz et al. | 239/428.5 |
| 4,013,228 | 3/1977 | Schneider | 239/401 |
| 4,103,827 | 8/1978 | Kumazawa | 239/8 |
| 4,330,086 | 5/1982 | Nysted | 239/8 |
| 4,505,431 | 3/1985 | Huffman | 239/428 |

FOREIGN PATENT DOCUMENTS

| | | | |
|---|---|---|---|
| 613919 | 2/1961 | Canada . | |
| 681554 | 3/1964 | Canada | 400/5 |
| 1063104 | 8/1959 | Fed. Rep. of Germany | 234/311 |
| 557993 | 8/1923 | France . | |
| 625721 | 9/1978 | U.S.S.R. | 169/15 |
| 261752 | 11/1926 | United Kingdom | 169/15 |
| 714844 | 9/1954 | United Kingdom | 239/428 |
| 754234 | 8/1956 | United Kingdom | 239/428 |
| 1188950 | 3/1965 | United Kingdom | 239/601 |
| 1117134 | 6/1968 | United Kingdom | 239/427.5 |

OTHER PUBLICATIONS

Car Wash Foamers—Model 294CV.

DEMA Model 294CHDF Dual Feed High Pressure Spray Foam Installation Instructions.

DEMA Spray Foam Model 294C—Installation Instruction.

DEMA Foamer Model 294CDF—294C—Equip. Limits Eval.

DEMA Foamer Model 293DM—Equip. Eval.

*Primary Examiner*—Andres Kashnikow

*Assistant Examiner*—Kevin P. Weldon

*Attorney, Agent, or Firm*—Merchant, Gould, Edell, Welter & Schmidt

[57] ABSTRACT

An aspirating foamer having a water inlet path to admit water into the nozzle assembly, two diametrically opposed foaming material inlet paths perpendicular to the water inlet path, and a conical conduit wherein the pressurized water and foaming materials mix and are allowed to expand; and an air inlet valve at the exiting end of the conical conduit for admitting air; and an exiting path for the foam. In one foamer (2) the conical conduit has an outwardly tapered angle of approximately 5 degrees (from centerline) initially with an immediate increase to an outwardly tapered angle of about 7 degrees in the second half of the conical conduit. In another embodiment foamer (102) according to the invention the conical conduit has an initial taper of 2½ degrees followed by a 15 degree diffusion angle and then a 7 degree angle.

14 Claims, 2 Drawing Sheets

ASPIRATING FOAMER

The present application is a continuation-in-part application of application Ser. No. 799,423, filed Nov. 19, 1985, now abandoned.

BACKGROUND OF THE INVENTION

1. Field of the Invention

This invention relates generally to a method and apparatus for foaming one or more liquid products. In particular, this invention relates to apparatus and methods involving aspirators with a compound exit angle on the discharge side of the foamer, thereby maintaining maximum efficiency across the aspirator throat, while permitting the use of a wide range of inlet pneumatic and hydraulic pressures.

2. Description of the Related Technology

Foams consist of a mass of gas bubbles dispersed in a liquid. The bubbles are separated from each other by thin films of liquid, most of the volume being attributable to the gas phase.

The desirable characteristics of foams depend upon their application. For example, shampoos and bubble bath compositions form slow draining and persistent foams. For fire fighting, the foam should resist destruction by contact with fuel and exposure to high temperatures. On the other hand, for laundering and washing machines, too much foam should be avoided. The mechanics of foam formation has therefore evolved into a subject of considerable technical importance.

Properties of foams are influenced by a variety of factors, such as the extent of adsorption from solution at liquid gas interfaces, the rheological characteristics of the adsorbed films, gaseous diffusion, bubble size distribution and temperature. Foam properties are primarily dependent upon the chemical composition and characteristics of the adsorbed films. Foaming properties cannot be related or described by a single specific property or attributed to one constituent of a multi-component composition.

The various methods for making foam differ mostly in the way the gas is introduced into the solution. The most common methods consist of bubbling gas through orifices, by the use of injectors, by agitation, or by various other mechanical means, as well as by chemical generation of gas in the liquid. The basic apparatus used to form foam typically consists of a mixing chamber into which the foaming material is introduced by means of one or more nozzles. Some mechanism is then provided to facilitate the entrainment of air, thereby converting the solution into foam, which then usually goes through disks or some sort of mechanical atomizer that disperses the foam into smaller bubble sizes. In such an apparatus, a carrier liquid under pressure typically passes through a restricted throat which opens into an expansion chamber, the chamber being coaxial with the throat. The conduit for introducing the second liquid into the device usually enters from the side, such that suction created in the expansion chamber forces the second liquid to enter the main carrier stream where mixing takes place. A foam producing apparatus of this type is disclosed in U.S. Pat. No. 2,571,871, which discloses a cylindrical throat which opens abruptly into a coaxial cylindrical expansion chamber of a larger cross section, with a conduit entering the expansion chamber from the side adjacent the junction of the throat and chamber. The proper proportions of the constituents of the foam are maintained by the introduction of a screen or perforated disk placed at the discharge end, thereby offering some resistance to the discharging stream.

Ideally, the turbulent mixing action of air and liquid within the expansion chambers should be sufficient in itself to produce a foam of the desired consistency, but the use of wire screens, perforated plates or fibrous materials has in the past been necessary to improve the breaking up of the initial mixture into a substantially uniform foam. A device which has multiple chambers of fibrous materials coupled with perforated plates is disclosed in U.S. Pat. No. 2,715,045. It should be noted that the foamer disclosed in U.S. Pat. No. 2,715,045 uses high pressure air to entrain a liquid foaming product. Most modern foamers, by contrast, utilize a liquid product stream and either entrain or otherwise introduce air into the liquid. The present invention is directed to the latter type of foamer, and the remaining discussion will accordingly focus on liquid stream foamers.

In an attempt to increase the level of turbulence within the mixing chambers of a foam producing device, the dimensions of the chamber and the dimensions of the orifice which permit the entrainment of air must be chosen carefully to provide the optimum combination of velocities, turbulence and atomization. U.S. Pat. No. 2,774,583 discloses an early attempt to carefully select orifice and chamber sizes, yet the presence of perforated screens was still necessary in order to obtain a foam having the desired small particle size.

Another problem faced by foam producing apparatus designers is the need to entrain a sufficient amount of air to mix with the quantity of liquid which must be delivered for the particular application, such as firefighting. Since the air is generally entrained by means of low pressure produced by the velocity of the liquid, the liquid must move at a relatively high velocity to produce the low pressures needed. For example, in U.S. Pat. No. 3,122,327, the foam forming liquid is introduced into the mixing chamber under high pressure, and is forced to pass through narrow orifices, thereby producing the high velocity necessary to draw sufficient atmospheric air into the mixing area by means of aspiration holes (column 3, lines 58–74).

One problem shared by the devices so far discussed is that the orifices which provide access to the mixing chamber are of a fixed size and tend to emit relatively constant amounts of air over wide variations of liquid flow. U.S. Pat. No. 3,188,009 discloses a series of clapper valves which open and close the aspiration orifices in response to the suction created by the high velocity liquid flowing through the mixing chamber. The amount of air introduced into the foam is therefore automatically adjusted according to the instantaneous fluid flow. A related problem which occurs in foam producing nozzles is known as "flooding". Flooding occurs when the liquid pressures become so high that the liquid is expelled outwardly through the air inlet orifices. U.S. Pat. No. 3,388,868 discloses a solution to this problem in which the air enters through inlet openings 26 and is then transported some distance through a duct 16 before coming into contact with the fluid in a mixing chamber, the fluid being conducted through a separate series of tubes 22. This arrangement apparently inhibits the foam forming action and a number of perforated screens and shields are required to produce foams having the desired characteristics.

The problem with the devices just discussed is that the air is introduced into the mixing chamber at a relatively low velocity, the velocity imparted to the air being caused only by the low pressure within the mixing chamber. An attempt to increase the entrained air velocity is disclosed in U.S. Pat. No. 3,799,450, where the inlet port is tapered so as to provide air of higher velocity and increase the area of contact between the air and liquid. The outer surface of the inlet port is a relatively large area and tapers to a very small orifice at the point where it enters the mixing chamber, U.S. Pat. No. 3,836,076 discloses a nozzle with an inclined annular surface formed on the inner periphery of the nozzle body. This surface is designed to deflect the stream inwardly to mix the foam producing agent with the gas which is present within the nozzle. The second embodiment of this patent uses a circular impingement disk to disrupt the flow and thereby generate foam.

Most relevant to the present invention is U.S. Pat. No. 3,822,217, in which water, air and detergent are introduced within a small cylindrical chamber to produce foam. The detergent is introduced to a tapering conduit and is entrained by the flow of water. The water/detergent mixture continues down the tapering conduit which abruptly changes its angle of taper into a larger expansion chamber. In the final stage, air is introduced to the water/detergent mixture inside a chamber having a uniform circular cross section. An alternate embodiment shows the air being introduced into the second stage of a tapering conduit having a compound angle.

U.S. Pat. No. 3,853,784 discloses a similar foam producing device in which an obstruction is placed at the point where the angle of taper of the mixing chamber abruptly increases. This obstruction is used to adjust the velocity of liquids passing through the chamber according to their different viscosities.

Another problem faced by the designer of a foam generating apparatus is, that in order to produce a uniform foam, there often must be some sacrifice in the velocity of the emerging mixture. Thus, although a uniform foam may be produced, the low velocity makes distributing the foam very difficult. A foam spraying device which attempts to address this problem is disclosed in U.S. Pat. No. 3,918,647. The foam sprayer disclosed therein provides a progressive control over the degree and quality of foaming action that can be achieved with an air aspirating type foamer by varying the angle of divergence of a liquid stream exiting from an orifice and directed to a pressure reducing passageway, including a sharply outwardly tapered portion terminated in a restricted throat passageway portion opening into an expansion chamber. The narrowest useful stream flowing from the orifice is a relatively concentrated liquid stream which initially strikes the walls of the throat passageway portion to produce a stream with a long throw accompanied by a modest degree of foam. By progressively increasing the angle of the stream flowing from the orifice, the stream becomes less concentrated and progressively more mist like, and strikes larger portions of the pressure reducing passageway, including the tapered portion thereof. An increase in foaming action occurs coupled with a reduction in the spray throw distance when the widest portion of the diverging stream exiting from the orifice strikes the end section of the tapered portion of the pressure reducing passageway. Such a spray pattern has been found generally to produce foam with good throw. However, even thicker foams can be achieved when the widest portion of the diverging stream initially strikes the pressure reducing passageway at points substantially behind the end section of the tapered passageway portion, but the progressively reduced throws which reach impractical magnitudes after only a small adjustment.

An improvement on the previous patent is disclosed in U.S. Pat. No. 4,013,228 wherein a longitudinal passageway in which pressure is reduced is physically moved in relation to the discharge orifice such that the characteristics of the diverging exit stream do not chamber with increasing foam viscosities.

Finally, U.S. Pat. No. 4,330,086 discloses a foam generating nozzle in which the expansion chamber is interrupted by a small pin which causes the foam to be deflected against the walls of the expansion chamber thereby promoting more thorough mixing.

The references just discussed, while sometimes satisfactory for their intended purpose, have left something to be desired in that they are either overly complex in design or else do not achieve the efficient mixture of components required to synthesize a satisfactory foam. The problem of mixing multiple components into a liquid stream which must then be mixed with air to produce a satisfactory foam, in a relatively passive device, has not been adequately addressed by these previous devices.

SUMMARY OF THE INVENTION

The subject invention addresses some of the disadvantages of the prior art, including those mentioned above, in that it comprises a relatively simple aspirating foamer which may be used to provide satisfactory foam at a wide range of low pneumatic and hydraulic pressures. There is no need for electrical power and preferred embodiments of the device are chemically resistant to a broad range of acids, alkalines and halogens.

The subject invention includes a foam generating nozzle. The nozzle is foamed as a generally tubular assembly having two ends, water or another liquid being introduced at one end of the assembly. One or more products are added to the water in the venturi section of the nozzle. In a "standard pressure" embodiment, the flow then diffuses in a first diffuser section typically having a ten degree diffusion angle (where uniform mixing of product and water is most important), and then diffuses further in a second diffuser section having a greater diffusion angle, typically on the order of fourteen degrees (where the air is blended to make the foam). In a "high pressure" embodiment, the flow first diffuses through a five degree diffuser (product blending conduit), which is required for adequate venturi action, and then diffuses through a thirty degree included angle induces further blending. Preferably, a fourteen degree diffuser (air blending chamber) follows the thirty degree diffuser. Air is mixed with the product(s) at the downstream end of the second (or third) diffuser section. In the standard pressure embodiment, when supply water pressure is below 75 psig, the mixing air is injected at a pressure that is typically 5 to 10 psig below the incoming water pressure. In both embodiments, the air pressure is adjusted to give the foam the consistency desired. Thus the high pressure embodiment generally has the air pressure set at 55–70 psig in order to achieve a thick foam. Any greater pressure will cause the foam to become dry, while any less pressure will result in foam that is excessively moist.

DESCRIPTION OF THE PREFERRED EMBODIMENT

Figure 1:
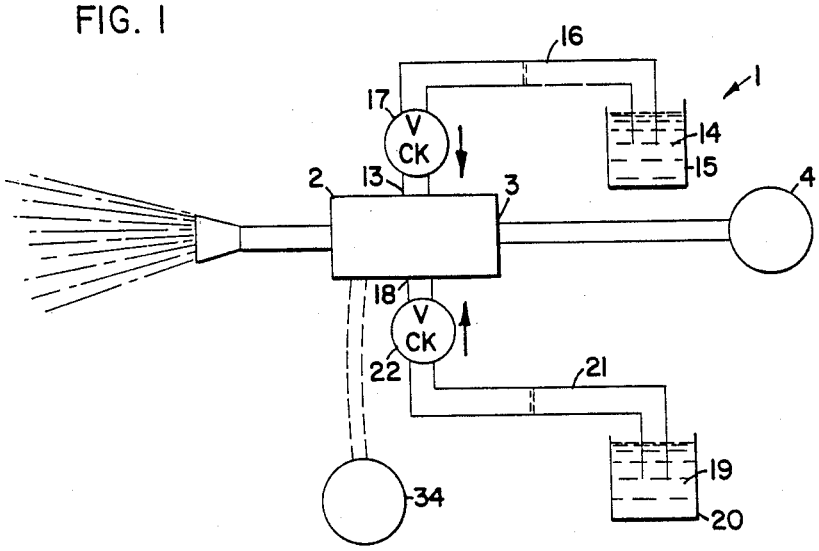
FIG. 1 is a schematic view of the aspirating foamer which constitutes the subject invention.

The preferred embodiments of the subject invention will now be discussed in some detail in conjunction with all of the figures of the drawings, wherein like parts are designated by like reference numerals, insofar as it is possible and practical to do so.

Referring now to FIG. 1, there is shown a standard pressure aspirating foamer 1, comprising a nozzle assembly 2. The nozzle assembly 2 includes four inlet paths and one exit, or discharge path. The first inlet path 3 admits water into the nozzle assembly from some convenient water source 4. The water, or hydraulic, pressure typically ranges from a value of 30 pounds per square inch gauge to 80 pounds per square inch gauge, these pressures being the same as those usually found at the outlet of a faucet or spigot connected to a municipal water supply system. However, the standard pressure foamer is capable of producing excellent foam up to a water supply pressure of 300 psig, with a gradual degradation in performance at water supply pressures of between 300 and 350 psig.

Figure 2:
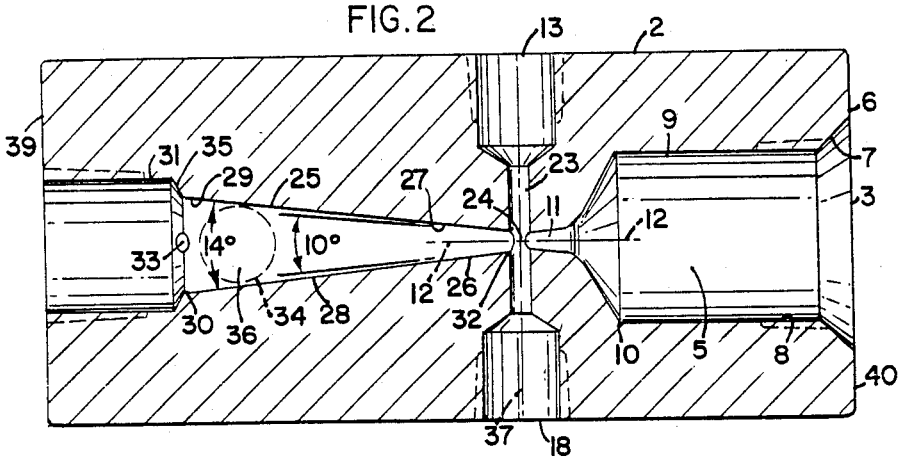
FIG. 2 is a side elevation shown in cross-section of a first embodiment of the aspirating foamer as depicted in FIG. 1.
Figure 3:
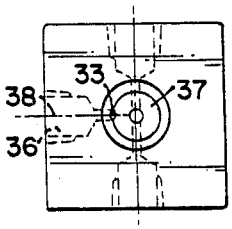
FIG. 3 is an end view of the first embodiment of the invention as shown in FIG. 1.

As may be seen more clearly in FIG. 2, inlet path 3 actually consists of a sequentially tapering chamber 5 formed within nozzle assembly 2. The entrance to chamber 5 meets the end surface 6 of nozzle assembly 2 at a 45 degree angle, forming bevelled surface 7. In the preferred standard pressure embodiment, bevelled surface 7 extends inwardaly from surface 6 a distance of approximately 0.187 inch, at which time the bevelled surface 7 ends and a right cylindrical orifice 8 begins. The orifice 8 typically has a diameter of 0.922 inches. The wall 9 of cylindrical orifice 8 continues from its intersection with bevelled surface 7 toward the interior of nozzle assembly 2 a distance of approximately 1⅛ inch until transition line 10 is reached, at which point a relatively steep taper (118 degrees included angle) begins, transitioning to a nozzle 11, the nozzle 11 having a diameter of approximately 0.078 inches. The nozzle 11 itself has a small taper of about 5 degrees with respect to the nozzle center line 12.

The second inlet path 13 enters the nozzle assembly 2 at an angle perpendicular to centerline 12 of inlet path 3. Inlet path 13 is provided to allow the admission of liquid product 14 into the nozzle assembly 2. Liquid product 14 is typically housed in container 15 such that liquid product 14 is at approximately atmospheric pressure. The path 16 of liquid product 14 is interrupted by check valve 17, check valve 17 permitting the admission of liquid product 14 into the nozzle assembly only when the pressure within nozzle assembly 2 is lower than the ambient pressure within container 15. The third inlet path 18 enters nozzle assembly 2 at a point exactly opposite that of inlet path 13. A second liquid product 19 is also stored at atmospheric pressure within a suitable container 20. The path 21 of second liquid product 19 is similarly interrupted by check valve 22 which also permits flow of liquid product 19 only into nozzle assembly 2 and prevents any flow from nozzle assembly 2 towards container 20.

Liquid products 14 and 19 can be any of a wide variety of compositions. For example,, product 14 could be a stabilized enzyme solution such as that described in U.S. Pat. No. 4,243,543, and sold by the assignee herein under the designatioN Dy-Gest TM I, and product 19 could be an alkaline builder formulation such as that sold by the assignee herein under the designation Dy-Gest TM II. Preferred solutions include 1% to 3% Dy-Gest TM I enzyme solution and 1% to 3% Dy-Gest TM II alkaline builder formulation. Other detergent and foam builder combinations are contemplated by the invention. Foam builders, as is well known, contain surfactants which are used in conjunction with low or nonfoaming detergents.

Of course, some products 14 and 19 could be used sequentially. For example, product 14 could be a conventional foaming alkaline detergent whereas product 19 could be a passivating acid detergent to be used following an application of product 14.

As can best be seen in FIG. 2, inlet path 13 and inlet path 18 are diametrically opposed to each other and are interconnected to each other via pipe 23. In the preferred embodiment, the diameter of pipe 23 is approximately 0.109 inches. The dimensional characteristics of inlet path 13 and inlet path 18 are substantially identical, each being formed as a right cylinder having a diameter of approximately 7/16 of an inch. Each cylinder penetrates nozzle assembly 2 a distance of approximately ½ inch before tapering to a 0.109 inch diameter orifice which adjoins pipe 23. Nozzle 11 of inlet path 3 joins pipe 23 at its approximate midpoint 24, thereby allowing inlet paths 3, 13 and 18 to be in fluid communication with each other.

Diametrically opposed to nozzle 11 and perpendicular to exiting pipe 23 at its approximate center point 24 is a conical conduit 25. Conical conduit 25 is actually made up of a first and second portion, the first portion 26 adjoining pipe 23 at its midpoint 24. The walls 27 of first portion 26 form an angle of approximately 5 degrees with the center line 12. The second portion 28 of conical conduit 25 has a slightly greater angle of taper, the walls 29 forming an angle with center line 12 of approximately 7 degrees.

Typically, the length of conical conduit 25 is approximately 1.93 inches.

The exit end 30 of conical conduit 25 tapers outwardly to form a right cylinder 31, which extends an additional distance of approximately 0.73 inches, thereby exiting nozzle assembly 2. The diameter of cylinder 31 is approximately 0.703 inches. As is well known, a right circular cylinder is a cylinder which has a circular cross section, parallel sides and a constant diameter.

The orifice 32 which permits fluid communication between pipe 23 and conical conduit 25 has a diameter of approximately 0.104 inches. The ratio of the diameter of nozzle 11 (0.078 inches in the preferred embodiment) to the diameter of orifice 32 (0.104 inches in the preferred embodiment) is approximately 0.75. As the actual dimensions of the nozzle 11 and orifice 32 are varied according to volumetric requirements, this 0.75 ratio must be maintained as it is a relatively critical dimensional relationship.

Air is introduced into nozzle assembly 2 through orifice 33 which is connected to a suitable supply of air 34. Air is typically supplied at a pneumatic pressure of 30 pounds per square inch gauge to 55 pounds per square inch gauge. The volumetric ratio of air to liquid within the nozzle assembly 2 is typically on the order of 7 to 20 parts air to 1 part liquid. Orifice 33 enters nozzle assembly 2 at the transition zone 35 where conical conduit 25 joins right cylinder 31.

The orifice 33 has a diameter of 0.109 inches, and enters the transition zone displaced at an angle of 30 degrees of a plane normal to center line 12.

Air is introduced into orifice 33 through air inlet path 36. Air inlet path 36 enters the nozzle assembly 2 at an angle perpendicular to the plane defined by center line 12 and center line 37. Orifice 33 exits air inlet path 36 at an angle of 30 degrees from center line 38.

The ratio of the diameter of orifice 33 (0.109 inches in the preferred embodiment) to the diameter of pipe 23 (0.109 inches in the preferred embodiment) is approximately 1. As the actual dimensions of path 23 are varied according to volumetric requirements, this 1.00 ratio must be maintained as it is a relatively critical dimensional relationship.

The distance from centerline 37 to assembly face 39 is approximately 2.656 inches and the distance from center line 37 to assembly foot 40 is approximately 1.844 inches. The distance from center line 38 to assembly face 39 is approximately 1.06 inches and the distance from center line 38 to assembly foot 40 is approximately 3.44 inches. The length of assembly 2 defined as the distance from assembly face 39 to assembly foot 40 is approximately 4.5 inches. The height and width of assembly 2 are approximately equal, each being approximately 2.00 inches.

Ratios which should be maintained when aspects of the nozzle assembly 2 are varied are: the diameter of pipe 23 (0.109 inches in the preferred embodiment) to the diameter of nozzle 11 (0.078 inches in the preferred embodiment) at approximately 1.4; and the diameter of pipe 23 (0.109 inches in the preferred embodiment) to the diameter of orifice 32 (0.104 inches in the preferred embodiment) at approximately 1.05.

Figure 6:
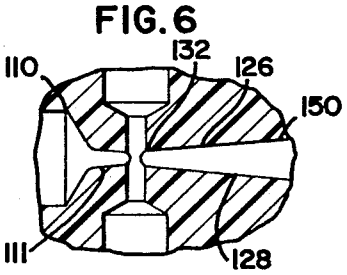
FIG. 6 is a sectional view taken of the circular region of FIG. 4 depicting annular relationships.
Figure 4:
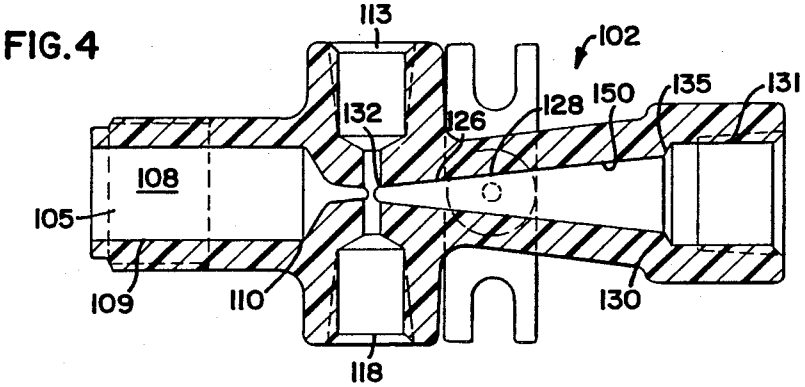
FIG. 4 is a top view shown in cross section of a second embodiment of the aspirating foamer diagrammatically depicted in FIG. 1.
Figure 5:
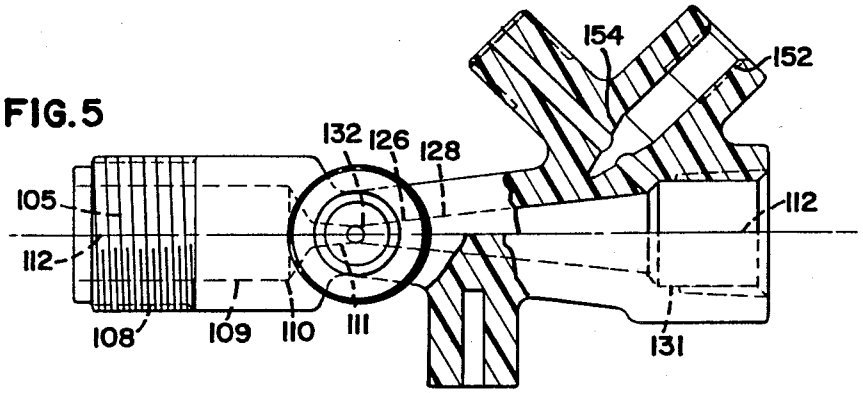
FIG. 5 is a side elevation shown in cross section of the embodiment shown in FIG. 4.

FIGS. 4, 5 and 6 shown a second embodiment 102 of the present invention. Nozzle assembly 102 is similar to the standard pressure nozzle assembly 2 described above, but it is capable of utilizing water having pressure ranging from at least 50 to 1200 psi for preferred embodiments. Thus, where assembly 2 can function as a "standard pressure" foamer in the sense that it is completely effective for water pressures ranging from 30 to 300 psi, foamer 102 is a "high pressure" foamer in the sense that it can produce excellent foam over a wide range of hydraulic pressure, typically from 100 to 1200 psi. The "standard pressure" nozzle 2 can throw or project foam horizontally for a distance of perhaps fifteen feet (at 30 psi) to thirty five feet (at 100 psi), and vertically to a height of six to seven feet (at 30 pis) to forty feet (at 300 psi) enabling it to clean very tall silos, for example. The primary advantage of high pressure foamer 102 when compared with standard pressure foamer 2 is that the high pressure foamer has a higher impact velocity at close range (25 feet or less) which helps to break down gross soils.

Many of the features of foamer 102 are substantially identical to those of foamer 2, in which case the reference numeral "1xx" will be applied with the "xx" portion being common between the identical components. Where the foamers 2 and 102 are different, a unique "suffix" will be used. The following table gives the preferred dimensions for foamer 102:

Nozzle/Assembly 102 Preferred Dimensions

| Component | Preferred Value (inches unless otherwise specified) |
|---|---|
| inlet orifice 108, diameter | 0.500 |
| wall 109, length to transition line | 1.437 |
| nozzle 111, diameter | 0.052 |
| pipe 123, diameter | 0.073 |
| inlet path 113, diameter | .563 O.D. chamber ¼ npt |
| inlet path 118, diameter | .563 O.D. chamber ¼ npt |
| conduit 126, length | 0.437 |
| conduit 126, included angle | 5 degrees |
| conduit 128, length | 0.219 |
| conduit 128, included angle | 30 degrees |
| conduit 150, length | 1.217 |
| conduit 150, included angle | 14 degrees |
| right cylinder 131, length | 0.720 |
| right cylinder 131, diameter | .845 O.D. chamber ½ npt |
| orifice 132, diameter | 0.062 |
| ratio of diameter of nozzle 111 to diameter of nozzle 132 | 0.84 (undimensioned) |
| orifice 133, diameter | 0.125 |
| angle between centerline 138 and centerline 112 | 45 degrees |
| distance from centerline 137 to assembly face 139 | 2.660 |
| distance from centerline 137 to assembly foot 140 | 1.840 |
| ratio of diameter of pipe 123 to diameter of nozzle 111 | 1.400 |
| ratio of diameter of pipe 123 to diameter of orifice 132 | 1.180 |

Of particular significance is the fact that nozzle 102 includes a very shallow angle (5 degrees) first diffuser 126 followed by a comparatively very steep angle (30 degrees) second diffuser 128. The sharp transition induces turbulence and foaming over a very large range of water pressures, approximately 50 to 1200 psi for preferred embodiments. The sharp transition also effectively prevents air, injected through orifice 133, from interfering with the venturi action provided proximate the midpoint 124. High pressure air can interfere with the venturi in an analogous fashion to "flooding" wherein injected liquid interferes with the entrainment of air (for foamers that use entrained air rather than injected air).

The 30 degree diffuser 128 terminates at its large end at a less drastic 14 degree diffuser 150. The diffuser 150 creates less pressure drop than 30 degree diffuser and allows for a fairly smooth transition to a foam hose (not shown). Thus, foamer 102 actually includes three diffusers, not two like foamer 2. However, it can be said of both diffusers that they contain a compound angle diffuser; the nozzle 102 simply includes a third diffuser in addition to the compound angle diffuser.

Foamer 102 also includes an integral needle valve 152. Valve 152 includes a needle 154 having male threads which cooperatively engage female threads in the body of the foamer. The angle between the centerline 160 of the needle 154 and the centerline 130 is 90 degrees.

In operation, foamer 102 is connected as shown in FIG. 1 (with foamer 102 replacing foamer 2 in the drawing). A high pressure water source (usually between 200 and 1000 psi) is used rather than the (30 to 300 psi) standard pressure water source described in connection with FIG. 1. Preferably a 50 to 75 psi pressurized air source will be adjusted to control the moistness of the foam (the water pressure always exceeds the air pressure in the high pressure embodiment 102). Otherwise, the operation of foamer 102 is identical to that of foamer 2. Foamer 102 is capable of producing high quality foam and projecting such foam approximately 30 feet (at 750 psi) to 40 feet horizontally (at 1000 psi), at a vertical height of six to seven feet. The foam may be projected vertically to a height of 30 feet (at 750 psi) to 40 feet (at 1000 psi).

It should be emphasized that the present invention is not limited to any particular components, materials or configurations, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having the specific configurations and shapes as presented herein. All alternative modifications and variations of the present invention which fall within the spirit and broad scope of the appended claims are included.

We claim:

1. A foam generating system, comprising:

(a) a source of liquid, the liquid being used as a medium in which to form and transport the foam, the source of liquid containing a solution consisting essentially of water;

(b) a first liquid product;

(c) a second liquid product; and (d) a nozzle assembly, comprising:

(i) a first inlet path, the first inlet path having a longitudinal axis, the first inlet path permitting the admission of the liquid into the nozzle assembly;

(ii) a second inlet path, the second inlet path entering the nozzle assembly at an orientation normal to the longitudinal axis of the first inlet path, the second inlet path permitting admission of the first liquid product into the nozzle assembly, the second inlet path being in fluid communication with the first inlet path;

(iii) a third inlet path, the third inlet path being diametrically opposed and coaxial to the second inlet path, the third inlet path permitting admission of the second liquid product into the nozzle assembly, the third inlet path being in fluid communication with the first inlet path and the second inlet path;

(iv) a conical diffusing conduit, the conical diffusing conduit having a narrow end and a wide end, the conical diffusing conduit having a longitudinal axis coaxial with the logitudinal axis of the first inlet path, the conical diffusing conduit having an inner wall that tapers substantially gradually at a compound angle, the inner wall which forms the narrow end of the conical conduit diverging from the longitudinal axis of the first inlet path at an angle somewhat less than encountered near the wide end of the conical diffusing conduit; and (v) a fourth inlet path, the fourth inlet path pemitting the admission of air into the nozzle assembly, the fourth inlet path terminating at an orifice, the orifice forming an opening proximate the wide end of the conical diffusing conduit, the fourth inlet path entering the conical diffusing conduit along an axis which lies in a first plane orthogonal to a second plane containing a second inlet path, such that the water, the first liquid product and the second liquid product are turbulently mixed adjacent to the narrow end of the conical diffusing conduit and transported toward the wide end of the conical diffusing conduit, the nozzle assembly thereby permitting the entrance of the liquid, the first liquid product, and a second liquid product such that a turbulent mixture is created which when mixed with air produces and discharges the foam.

2. The foam generating system of claim 1 wherein the conical diffusing conduit has an inner wall that tapers at a compound angle, and the inner wall of the narrow end of the conical diffusing conduit diverges at a first angle and the inner wall of the wide end of the conical diffusing conduit diverges at a second angle, the first angle being somewhat smaller than the second angle.

3. The foam generating system of claim 2, wherein the inner wall first angle is approximately five degrees with reference to the longitudinal axis of the first inlet path, and the inner wall second angle is approximately seven degrees with reference to the longitudinal axis of the first inlet path.

4. The foam generating system of claim 1, wherein the inner wall first angle is approximately two and one-half degrees with reference to the longitudinal axis of the first inlet path, and the inner wall second angle is approximately 15 degrees with reference to the longitudinal axis of the first inlet path.

5. The foam generating system according to claim 1, wherein the inner wall first angle is approximately five degrees with reference to the longitudinal axis of the first inlet path, and the inner wall second angle is approximately seven degrees with reference to the longitudinal axis of the first inlet path.

6. A nozzle for generating foam by turbulently mixing a liquid medium with a plurality of liquid products, comprising:

(a) a longitudinal inlet path, the longitudinal inlet path permitting the introduction of the liquid medium into the nozzle, the longitudinal inlet path having a longitudinal axis;

(b) a longitudinal exit path, the longitudinal exit path having a lengthwise axis, the lengthwise axis being coaxial with the longitudinal axis of the longitudinal inlet path;

(c) a first liquid product inlet path directed into the nozzle at an orientation normal to the longitudinal axis of the first inlet path, the first liquid product inlet path having a major axis aligned such that a first liquid product flows in a direction substantially aligned with the major axis;

(d) a second liquid product inlet path directed into the nozzle at an orientation normal to the longitudinal axis of the first inlet path, the second liquid product path having a flow axis that is coaxial with the major axis of the first liquid product inlet path; and (e) an aspiration inlet path, the aspiration inlet path being located in a first plane normal to a second plane containing the longitudinal exit path, longitudinal inlet path, and first and second liquid product inlet paths.

7. The nozzle of claim 6, wherein the longitudinal inlet path has a portion which is formed as a right cylindrical cavity, the longitudinal inlet path having an entrance end and a discharge end, the entrance end having a first diameter and the discharge end having a second diameter smaller than the first diameter, the liquid medium entering the nozzle at the entrance end and passing through the discharge end of the longitudinal length path.

8. The nozzle of claim 7, wherein the longitudinal exit path is formed as a compound cone termination in a right exit cylinder, the cone transitioning to the right exit cylinder through a bevelled zone, the compound cone having a narrow end diameter and a wide end diameter.

9. The nozzle of claim 8, wherein the ratio of the narrow end diameter of the compound cone to the second diameter of the discharge end of longitudinal inlet path is approximately 1.333.

10. The nozzle of claim 9, wherein the aspiration inlet path enters the longitudinal exit path at the beveled zone between the compound cone and the right exit cylinder.

11. The nozzle of claim 10, wherein the longitudinal axis of the longitudinal inlet path, the major axis of the first liquid product inlet path, the lengthwise axis of the longitudinal exit path and the flow axis of the second liquid product inlet path all intersect at a common point such that the liquid medium first liquid product and second liquid product are turbulently mixed and flow into the compound cone.

12. The nozzle of claim 8, wherein the ratio of the narrow end diameter of the compound zone to the second diameter of the discharge end of longitudinal inlet path is approximately 1.19.

13. A foam generating system comprising:

(a) a source of liquid, the liquid being used as a medium in which to form and transport the foam, the source of liquid containing a solution consisting essentially of water;

(b) a first liquid product;

(c) a second liquid product; and (d) a nozzle assembly, comprising:

(i) a first inlet path, the first inlet path having a longitudinal axis, the first inlet path permitting the admission of the liquid into the nozzle assembly;

(ii) a second inlet path, the second inlet path entering the nozzle assembly at an orientation normal to the longitudinal axis of the first inlet path, the second inlet path permitting admission of the first liquid product into the nozzle assembly, the second inlet path being in fluid communication with the first inlet path;

(iii) a third inlet path, the third inlet path being diametrically opposed and coaxial to the second inlet path, the third inlet path permitting admission of the second liquid product into the nozzle assembly, the third inlet path being in fluid communication with the first inlet path and the second inlet path;

(iv) a conical diffusing conduit, the conical diffusing conduit having a narrow end and a wide end, the conical diffusing conduit having a longitudinal axis coaxial with the longitudinal axis of the first inlet path, the conical diffusing conduit having an inner wall that tapers substantially gradually at a compound angle, the inner wall of the narrow end of the conical diffusing conduit diverging at a first angle and the inner wall of the wide end of the conical diffusing conduit diverging at a second angle, the first angle being somewhat smaller than the second angle, wherein the inner wall diverges at a third angle at the wide end after diverging at the second angle; and (v) a fourth inlet path, the fourth inlet path permitting the admission of air into the nozzle assembly, the fourth inlet path terminating at an orifice, the orifice forming an opening proximate the wide end of the conical diffusing conduit, the fourth inlet path entering the conical diffusing conduit along an axis which lies in a first plane orthogonal to a second plane containing a second inlet path, such that the water, the first liquid product and the second liquid product are turbulently mixed adjacent to the narrow end of the conical diffusing conduit and transported toward the wide end of the conical diffusing conduit, the nozzle assembly thereby permitting the entrance of the liquid, the first liquid product, and a second liquid product such that a turbulent mixture is created which when mixed with air produces and discharges the foam.

14. The foam generating system of claim 13, wherein the first angle is approximately two and one-half degrees, the second angle is approximately 15 degrees, and the third angle is approximately seven degrees.

* * * * *